US010882651B2

(12) United States Patent
Wang et al.

(10) Patent No.: US 10,882,651 B2
(45) Date of Patent: Jan. 5, 2021

(54) SEALING DEVICE

(71) Applicant: LEADRUN PACKAGING TECHNOLOGY Co., Ltd., Hebei (CN)

(72) Inventors: Hongjing Wang, Hebei (CN); Ruisong Liu, Hebei (CN)

(73) Assignee: LEADRUN PACKAGING Technology Co., Ltd., Hebei (CN)

( * ) Notice: Subject to any disclaimer, the term of this patent is extended or adjusted under 35 U.S.C. 154(b) by 242 days.

(21) Appl. No.: 16/068,756

(22) PCT Filed: Jun. 20, 2016

(86) PCT No.: PCT/CN2016/086354

§ 371 (c)(1),
(2) Date: Jul. 9, 2018

(87) PCT Pub. No.: WO2017/219176

PCT Pub. Date: Dec. 28, 2017

(65) Prior Publication Data

US 2019/0016491 A1 Jan. 17, 2019

(51) Int. Cl.

| | |
|---|---|
| ***B65B 51/14*** | (2006.01) |
| ***B65B 31/06*** | (2006.01) |
| ***B65B 31/04*** | (2006.01) |
| ***B65B 43/46*** | (2006.01) |
| ***B65B 7/02*** | (2006.01) |

(52) U.S. Cl.

CPC ..... *B65B 51/146* (2013.01); *B65B 7/02* (2013.01); *B65B 31/048* (2013.01); *B65B 31/06* (2013.01); *B65B 43/465* (2013.01)

(58) Field of Classification Search

CPC ..... B65B 51/146; B65B 7/02; B65B 31/048; B65B 31/06; B65B 43/465

USPC ..... 53/512, 514, 79, 107

See application file for complete search history.

(56) References Cited

U.S. PATENT DOCUMENTS 5,062,252 A * 11/1991 Kupcikevicius ..... B65B 31/022 53/374.8
5,182,898 A * 2/1993 Tung ..... B65B 43/465 493/475

(Continued)

FOREIGN PATENT DOCUMENTS

CA 2826314 A1 * 11/2014 ..... B65B 43/465
CN 102883958 A 1/2013

(Continued)

*Primary Examiner* — Sameh Tawfik
(74) *Attorney, Agent, or Firm* — Craft Chu PLLC; Andrew W. Chu

(57) ABSTRACT

The sealing device includes a bag conveying mechanism, a sealing module, and a module conveying mechanism. The sealing module includes a base and an actuator, and a first sealing block and a second sealing block arranged on the base. The actuator is configured to open and close the clamping opening and includes a push rod and a horizontal actuation track. When the sealing module is moved along the conveying path of the module conveying mechanism, the horizontal guide post slides along the horizontal actuation track, and the horizontal actuation track drives the push rod via the horizontal guide post to move horizontally. Thus, the clamping opening is opened or closed.

12 Claims, 5 Drawing Sheets

(56) References Cited

U.S. PATENT DOCUMENTS

| | | | | |
|---|---|---|---|---|
| 5,642,599 | A * | 7/1997 | Tisma | B65B 7/06 53/373.6 |
| 5,860,270 | A * | 1/1999 | Gerwe | B29C 65/18 53/477 |
| 6,619,012 | B2 * | 9/2003 | Focke | B29C 65/18 53/374.9 |
| 10,414,531 | B2 * | 9/2019 | Ensor | B65B 1/12 |
| 2010/0018160 | A1 | 1/2010 | Fukeda et al. | |
| 2013/0152516 | A1 * | 6/2013 | Sammons | B65B 7/02 53/562 |

FOREIGN PATENT DOCUMENTS

| | | | |
|---|---|---|---|
| CN | 103832617 | A1 | 6/2014 |
| CN | 104228135 | A | 12/2014 |
| CN | 204197424 | U | 3/2015 |

* cited by examiner

SEALING DEVICE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to the technical field of packaging machinery, particularly to a packaging bag sealing device, more particularly to vacuum pumping, nitrogen charging and sealing device that carries of vacuum pumping, nitrogen charging and sealing of packaging bags.

2. Description of Related Art Including Information Disclosed Under 37 CFR 1.97 and 37 CFR 1.98

Treating filled packaging bags by vacuum pumping, nitrogen charging, and sealing with packaging techniques can greatly increase the freshness lifetime of the packaged products. Most vacuum pumping and nitrogen charging devices on existing packaging machines are in a vacuum chamber form and require pumping out all air from the air chamber. Consequently, the air pumping work involves heavy load and is time-consuming, and the equipment structure is complex.

BRIEF SUMMARY OF THE INVENTION

To overcome the drawbacks in the prior art, the present invention provides a sealing device, which can overcome the drawbacks in the art effectively.

To attain the object described above, the present invention employs the following technical scheme: a sealing device, comprising:

a bag conveying mechanism configured to convey packaging bags;

a sealing module configured to seal the opening of a packaging bag;

a module conveying mechanism configured to convey the sealing module so that the sealing module is moved synchronously with the packaging bag;

wherein, the sealing module is arranged above the packaging bag; the sealing module comprises: a base and an actuator, and a first sealing block and a second sealing block arranged on the base;

the base is arranged on the module conveying mechanism, the first sealing block is hinged to the base, and a clamping opening is arranged between the first sealing block and the second sealing block;

the actuator is configured to open and close the clamping opening, and comprises a push rod and an horizontal actuation track; the push rod is horizontally slidably arranged on the base, a gear transmission structure is arranged between the push rod and the first sealing block, the push rod drives the first sealing block to swing via the gear transmission structure, and thereby the clamping opening is opened or closed;

a horizontal guide post is arranged vertically on the push rod and slidably connected to the horizontal actuation track, and the horizontal actuation track is arranged along a conveying path of the module conveying mechanism;

in a process that the sealing module is moved along the conveying path of the module conveying mechanism, the horizontal guide post slides along the horizontal actuation track, the horizontal actuation track drives the push rod via the horizontal guide post to move horizontally, and thereby the clamping opening is opened or closed.

Furthermore, the push rod is perpendicular to the conveying path of the module conveying mechanism; in a projection on the horizontal plane, the distance between the horizontal actuation track and the module conveying mechanism is a horizontal control distance, and the size of the clamping opening is controlled by adjusting the horizontal control distance.

Furthermore, according to the horizontal control distance, the horizontal actuation track comprises a wider track section and a narrower track section, and the clamping opening is opened when the sealing module travels on the wider track section; the clamping opening is closed when the sealing module travels on the narrower track section.

Furthermore, a transition track section is arranged between the wider track section and the narrower track section; or the wider track section and the narrower track section are separated from each other, and a track switching device is arranged between the wider track section and the narrower track section, the track switching device comprises a spur gear and a gear driving device, and the push rod is provide with a toothed rack structure meshed with the spur gear; in a process that the sealing module is conveyed, the gear driving device pushes the push rod to slide horizontally via the spur gear and the toothed rack structure, and, as the open/close state of the clamping opening is changed, the distance between the horizontal guide post and the module conveying mechanism is adjusted, and thereby transition between the wider track section and the narrower track section is realized.

Furthermore, the gear driving device is a servo motor, hydraulic motor, pneumatic motor, or step motor, etc.

Furthermore, a horizontal guide slot is arranged on the horizontal actuation track, and the horizontal guide post is slidably arranged in the horizontal guide slot.

Furthermore, a bearing is arranged on the horizontal guide post, and the horizontal guide post is slidably arranged in the horizontal guide slot via the bearing.

Furthermore, the second sealing block is rotatably arranged on the base, a gear mechanism is arranged between the first sealing block and the second sealing block, and the first sealing block and the second sealing block swing synchronously via the gear mechanism; the clamping opening is closed when the first sealing block and the second sealing block are moved toward each other, and the clamping opening is opened when the first sealing block and the second sealing block are moved away from each other.

Furthermore, the first sealing block and the second sealing block are respectively provided with a heating block configured to heating up and sealing an opening part of the packaging bag on one side of the clamping opening, and the heating blocks are connected to a power supply unit.

Furthermore, the first sealing block and the second sealing block are respectively provided with a soft sealing strip made of an elastic material on one side of the clamping opening, and the first sealing block and the second sealing block clamp the packaging bag via the soft sealing strips.

Furthermore, the heating block is arranged above the soft sealing strip.

Furthermore, the sealing device further comprises a vacuum pumping and nitrogen charging module configured to perform vacuum pumping and nitrogen charging for the packaging bag, the vacuum pumping and nitrogen charging module comprises an air extraction and gas charging tube and a vertical actuation track, the air extraction and gas charging tube is arranged on the push rod in a way that it can slide up and down, and is connected to a vacuum generator and a nitrogen source respectively; the air extraction and gas charging tube extends into the packaging bag for vacuum pumping and nitrogen charging for the packaging bag when it is moved downward; the vertical actuation track is arranged along the horizontal actuation track, and the air extraction and gas charging tube is provided with a vertical guide post slidably connected to the vertical actuation track; in the process that the sealing module is moved along the conveying path of the module conveying mechanism, the vertical guide post slides along the vertical actuation track, the vertical actuation track drives the air extraction and gas charging tube to move up and down via the vertical guide post, and thereby the air extraction and gas charging tube extends into the packaging bag or retracts out of the packaging bag.

Furthermore, in a projection on the vertical plane, the distance between the vertical actuation track and the packaging bag is a vertical control distance, and the air extraction and gas charging tube can be controlled to extend into the packaging bag or retract out of the packaging bag by adjusting the vertical control distance.

Furthermore, according to the vertical control distance, the vertical actuation track comprises a higher track section, a lower track section, and transition sections that connect the higher track section and the lower track section; on the higher track section, the air extraction and gas charging tube has retracted out of the packaging bag; on the lower track section, the air extraction and gas charging tube has extended into the packaging bag;

the transition sections include an insertion transition section from the higher track section to the lower track section and an extraction transition section from the lower track section to the higher track section;

on the insertion transition section, the air extraction and gas charging tube extends from the outside of the packaging bag into the inside of the packaging bag gradually; on the extraction transition section, the air extraction and gas charging tube retracts from the inside of the packaging bag to the outside of the packaging bag gradually.

Furthermore, the insertion transition section is arranged above the horizontal actuation track correspondingly, and, as the vertical guide post travels along the insertion transition section towards the lower track section, the air extraction and gas charging tube extends into the packaging bag before the clamping opening is closed; the extraction transition section is arranged above the narrower track section correspondingly, and the air extraction and gas charging tube extracts from the packaging bag before the clamping opening is closed.

Furthermore, the narrower track section is provided with an extra-narrow track section on the corresponding track after the extraction transition section, and the sealing module seals the packaging bag on the extra-narrow track section; the horizontal control distance of the extra-narrow track section is smaller than the horizontal control distance of the narrower track section, so that the left sealing block and the right sealing block get closer to each other further, the soft sealing strips are compressed and deformed further, the heating blocks on the left sealing block and the right sealing block abut against the two sides of the packaging bag, and the heating blocks heat up and seal the opening part of the packaging bag.

Furthermore, a vertical guide slot is arranged on the vertical actuation track, and the vertical guide post is slidably arranged in the vertical guide slot.

Furthermore, a bearing is arranged on the vertical guide post, and the vertical guide post is slidably arranged in the vertical guide slot via the bearing.

Furthermore, the bag conveying mechanism is a chain transmission device, which comprises a first driving wheel, a first driven wheel, and a first chain; wherein, a tong configured to clamp the packaging bag is arranged on the first chain.

Furthermore, the module conveying mechanism is a chain transmission device, which comprises a second driving wheel, a second driven wheel, and a second chain; wherein, the base is arranged on the second chain.

Furthermore, the first driving wheel and the second driving wheel are arranged on the same main shaft and are in the same diameter, and the first chain and the second chain are at the same linear velocity.

Furthermore, the second chain is shorter than the first chain.

Furthermore, the air extraction and gas charging tube is connected to the vacuum generator and the nitrogen source respectively via a three-way control valve; or the air extraction and gas charging tube comprises an air extraction tube and a gas charging tube, wherein, the air extraction tube is connected to the vacuum generator, and the gas charging tube is connected to the nitrogen source through a pipeline via a control valve.

The above technical scheme of the present invention attains the following beneficial effects: with the sealing device provided in the present invention, only the air in the packaging bag has to be pumped out, i.e., the volume of air to be pumped out is smaller; in addition, many positions for vacuum pumping and nitrogen charging are provided, so that a plurality of packaging bags can be treated by vacuum pumping and nitrogen padding at the same time, and thereby the production efficiency is greatly improved. Moreover, the sealing device provided in the present invention is simple in structure and convenient to use, requires very low maintenance cost, and is easy to apply widely.

DETAILED DESCRIPTION OF THE INVENTION

Hereunder the present invention will be further detailed in embodiments with reference to the accompanying drawings. The following embodiments are provided only to describe the present invention, but should not be deemed as constituting any limitation to the scope of the present invention.

It should be noted: in the description of the present invention, unless otherwise specified, the term "a plurality of" means two or more; the orientation or position relations indicated by the terms "above", "below", "left", "right", "inside", "outside", "front end", "back end", "head part", and "tail part", etc., are based on the orientation or position relations indicated in the accompanying drawings. They are used only to ease and simplify the description of the present invention, rather than indicating or implying that the involved device or component must have a specific orientation or must be constructed and operated in a specific orientation. Therefore, the use of these terms shall not be deemed as constituting any limitation to the present invention. Besides, the terms "first", "second", and "third", etc., are only for a descriptive purpose, and should not be comprehended as indicating or implying relative importance.

In addition, it should be noted: in the description of the present invention, unless otherwise specified and defined explicitly, the terms "install", "interconnect", and "connect", etc. shall be interpreted in their general meanings, for example, a connection may be fixed connection, detachable connection, or integral connection; may be mechanical connection or electrical connection; or may be direct connection or indirect connection via an intermediate medium. Those having ordinary skills in the prior art should comprehend the specific meanings of the terms in the present invention in their context.

Figure 1:
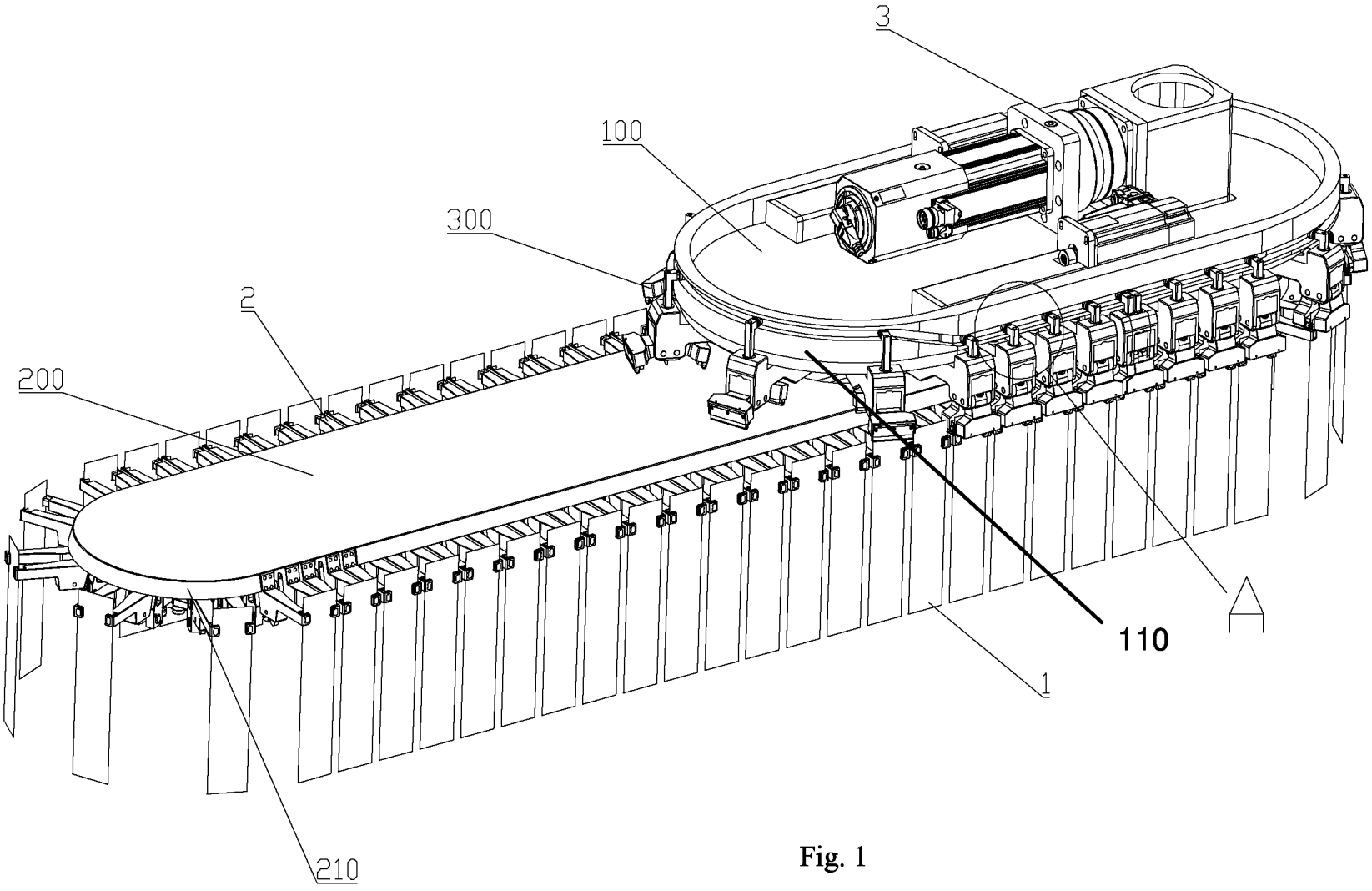
FIG. 1 is an upper perspective 3D view of the sealing device according to any embodiment of the present invention.
Figure 2:
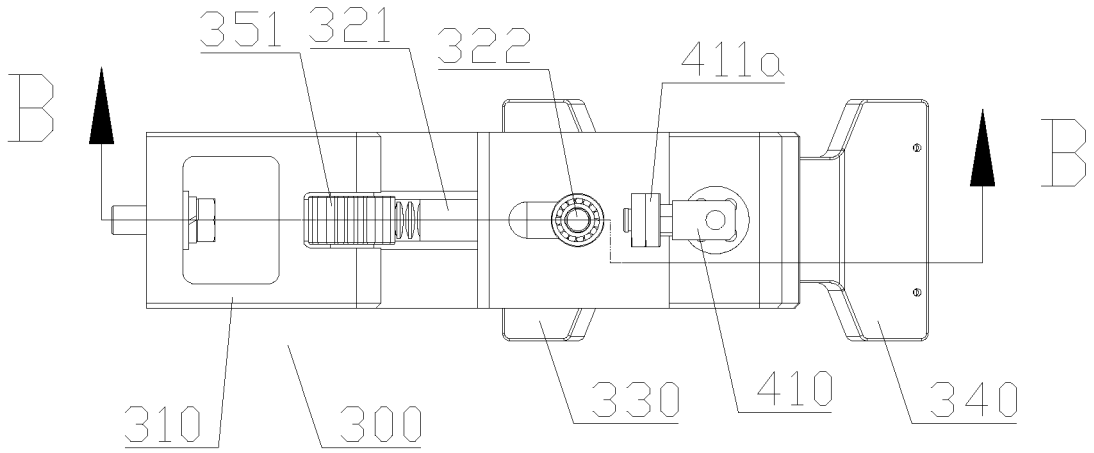
FIG. 2 is a top plan view of the sealing module according to an embodiment of the present invention.
Figure 3:
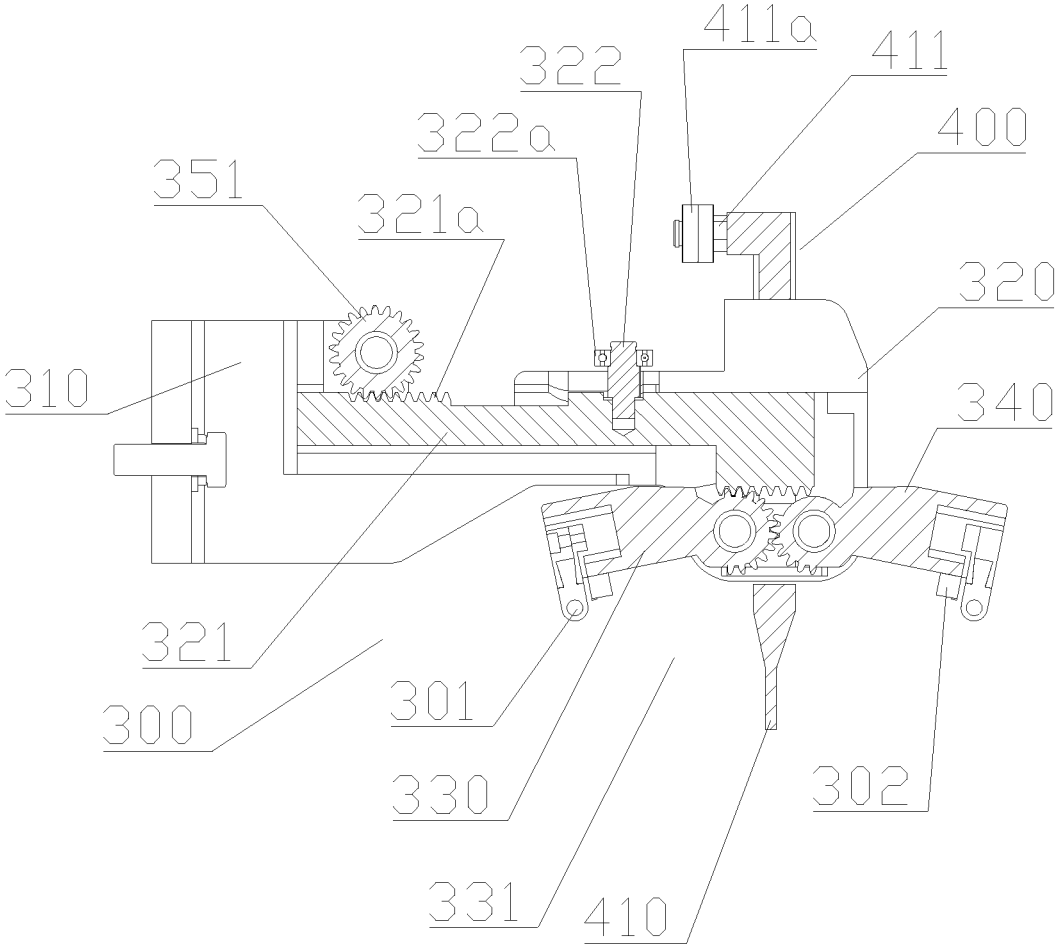
FIG. 3 is a staggered sectional view of line B-B of the structure in FIG. 2.
Figure 4:
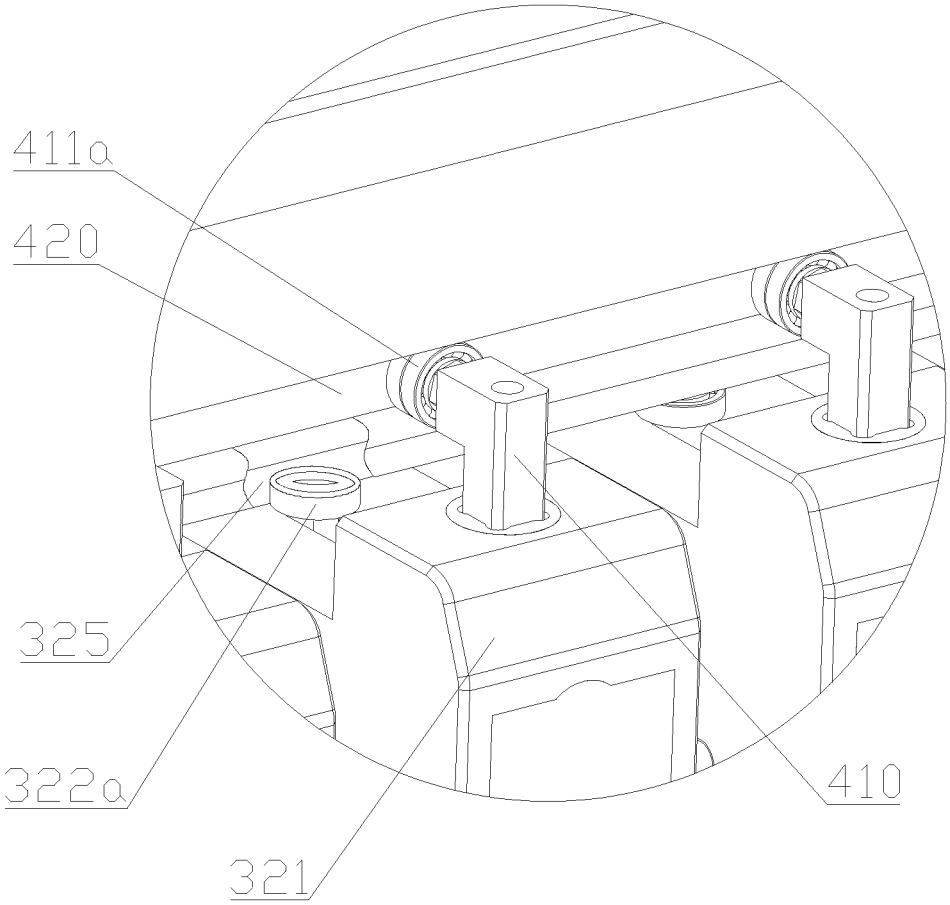
FIG. 4 is an enlarged perspective view of the portion A in FIG. 1.
Figure 5:
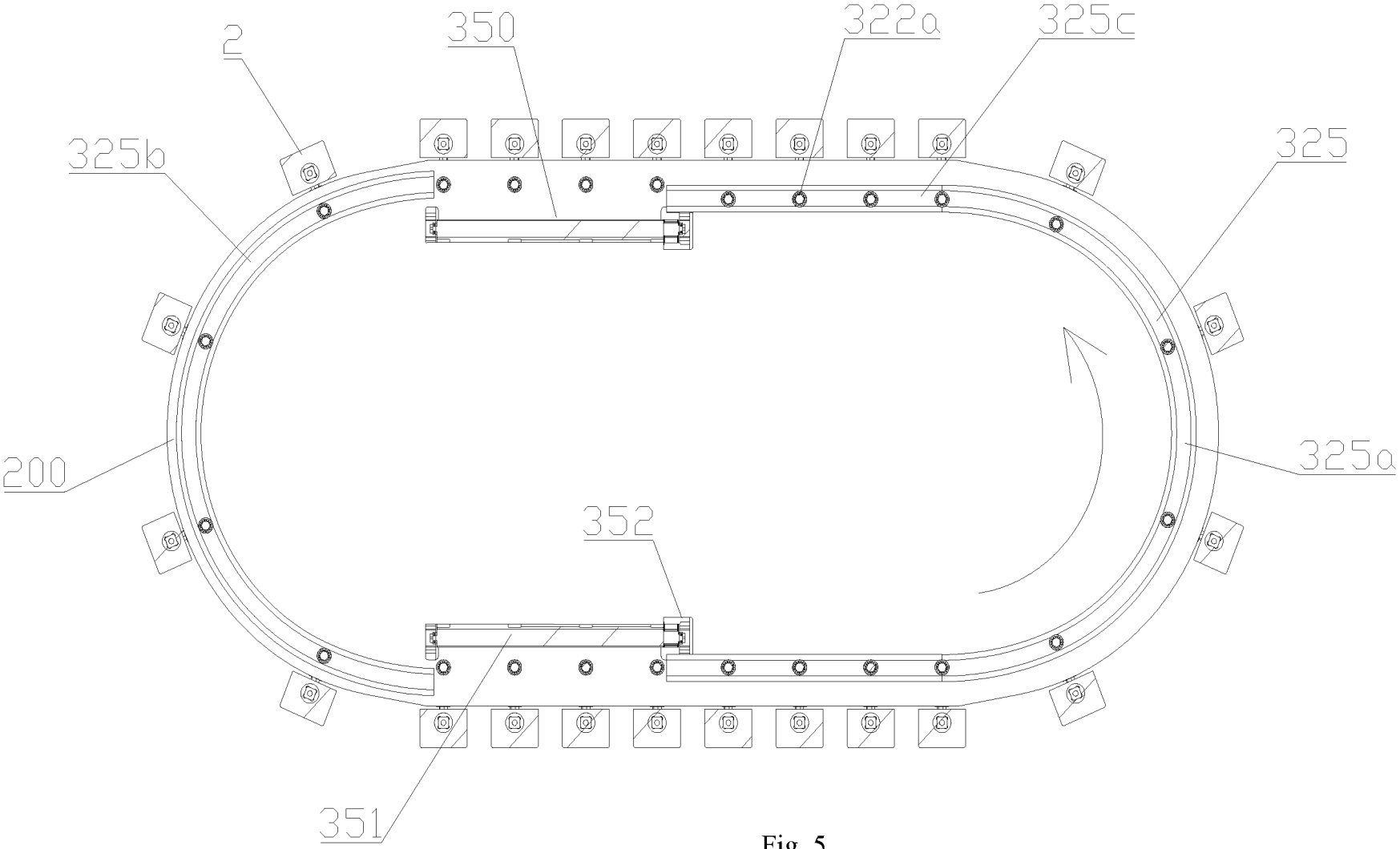
FIG. 5 is a top plan view of the horizontal actuation track according to the embodiment of the present invention.
Figure 6:
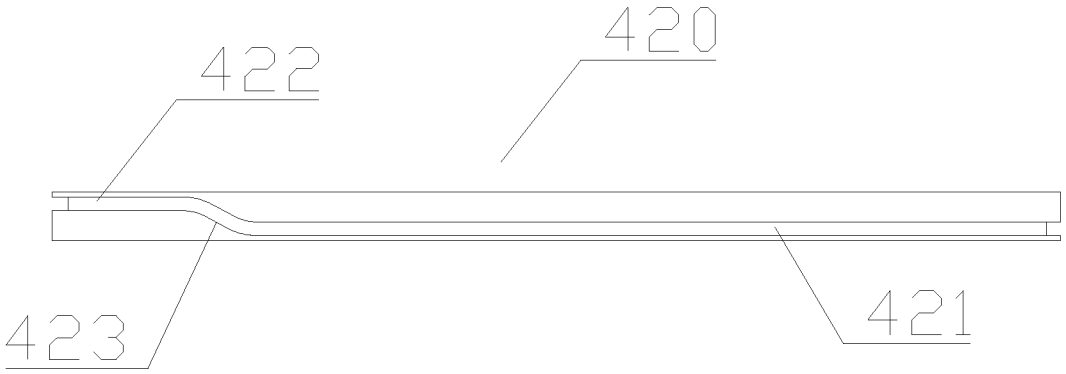
FIG. 6 is a schematic view of a structural diagram of the transition from the higher track section to the lower track section of the vertical actuation track.
Figure 7:
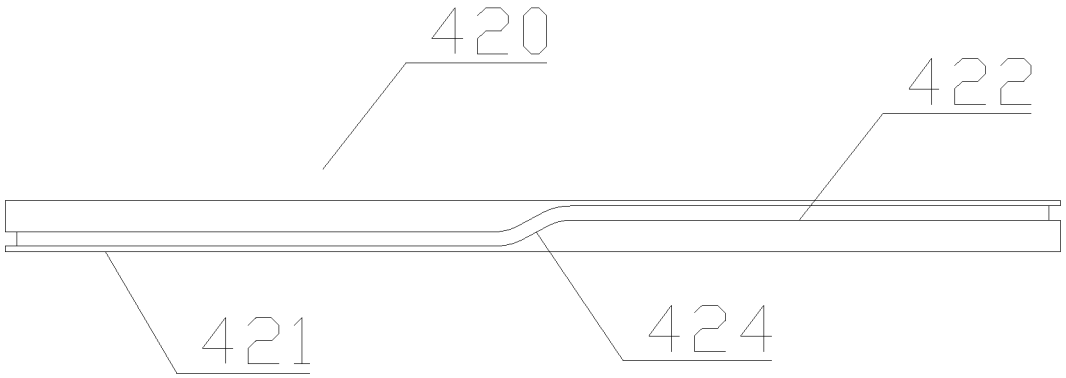
FIG. 7 is a schematic view of a structural diagram of the transition from the lower track section to the higher track section of the vertical actuation track.

As shown in FIGS. 1-7, the sealing device provided in this embodiment comprises:

a bag conveying mechanism 200 configured to convey packaging bags;

a sealing module 300 configured to seal the opening of a packaging bag;

a module conveying mechanism 100 configured to convey the sealing module so that the sealing module is moved synchronously with the packaging bag;

wherein, the sealing module 300 is arranged above the packaging bag 1; the sealing module 300 comprises: a base 310 and an actuator 320, and a first sealing block 330 and a second sealing block 340 arranged on the base 310;

the base 310 is arranged on the module conveying mechanism 100, the first sealing block 330 is hinged to the base 310, and a clamping opening 331 is arranged between the first sealing block and the second sealing block;

the actuator 320 is configured to open and close the clamping opening, and comprises a push rod 321 and an horizontal actuation track 325; the push rod 321 is horizontally slidably arranged on the base 310, a gear transmission structure is arranged between the push rod 321 and the first sealing block 330, i.e., the push rod 321 and the first sealing block 330 are respectively provided with teeth that are meshed with each other, the push rod 321 drives the first sealing block 330 to swing via the gear transmission structure, and thereby the clamping opening 331 is opened or closed;

a horizontal guide post 322 is arranged vertically on the push rod 321, a bearing 322*a* is arranged on the horizontal guide post 322, a horizontal guide slot is arranged on the horizontal actuation track 325, the horizontal guide post is slidably arranged in the horizontal guide slot via the bearing, the horizontal guide post 322 is slidably connected to the horizontal actuation track 325 via the bearing 322*a*, and the horizontal actuation track 325 is arranged along the conveying path of the module conveying mechanism 100;

in a process that the sealing module 300 is moved along the conveying path of the module conveying mechanism 100, the horizontal guide post 322 slides along the horizontal actuation track 325, the horizontal actuation track 325 drives the push rod 321 via the bearing and the horizontal guide post to move horizontally, and thereby the clamping opening 331 is opened or closed.

The push rod 321 is perpendicular to the conveying path of the module conveying mechanism 100; in a projection on the horizontal plane, the distance between the horizontal actuation track 325 and the module conveying mechanism 100 is a horizontal control distance, and the size of the clamping opening 331 is controlled by adjusting the horizontal control distance.

According to the horizontal control distance, the horizontal actuation track 325 comprises a wider track section 325*b* and a narrower track section 325*a*, and the clamping opening 300 is opened when the sealing module 331 travels on the wider track section 325*b*; the clamping opening 331 is closed when the sealing module 300 travels on the narrower track section 325*a*.

The wider track section 325*b* and the narrower track section 325*a* are separated from each other, and a track switching device 350 is arranged between the wider track section 325*b* and the narrower track section 325*a*, the track switching device 350 comprises a spur gear 351 and a gear driving device 352, wherein, the spur gear 351 is a spool gear, and the push rod 321 is provided with a toothed rack structure 321*a* meshed with the spur gear 351; in a process that the sealing module 300 is conveyed, the gear driving device 352 pushes the push rod 321 to slide horizontally via the spur gear 351 and the toothed rack structure 321*a*, and, as the open/close state of the clamping opening 331 is changed, the horizontal distance between the horizontal guide post 322 and the module conveying mechanism 100 is adjusted, and thereby transition between the wider track section 325*b* and the narrower track section 325*a* is realized.

Wherein, the gear driving device 352 is a servo motor.

Preferably, the second sealing block 340 is rotatably arranged on the base 310, a gear mechanism is arranged between the first sealing block 330 and the second sealing block 340, and the first sealing block and the second sealing block swing synchronously via the gear mechanism; the clamping opening is closed when the first sealing block and the second sealing block are moved toward each other, and the clamping opening is opened when the first sealing block and the second sealing block are moved away from each other.

The first sealing block 330 and the second sealing block 340 are respectively provided with a heating block 302 configured to heating up and sealing an opening part of the packaging bag on one side of the clamping opening 331, and the heating blocks 302 are connected to a power supply unit.

The first sealing block 330 and the second sealing block 340 are respectively provided with a soft sealing strip 301 made of an elastic material on one side of the clamping opening 331, and the first sealing block and the second sealing block clamp the packaging bag via the soft sealing strips. Wherein, the heating block 302 is arranged above the soft sealing strip 301.

The sealing device further comprises a vacuum pumping and nitrogen charging module 400 configured to perform vacuum pumping and nitrogen charging for the packaging bag, the vacuum pumping and nitrogen charging module 400 comprises an air extraction and gas charging tube 410 and a vertical actuation track 420, the air extraction and gas charging tube 410 is arranged on the push rod 321 in a way that it can slide up and down, and is connected to a vacuum generator and a nitrogen source respectively; the air extraction and gas charging tube 410 extends into the packaging bag 1 for vacuum pumping and nitrogen charging for the packaging bag 1 when it is moved downward; the vertical actuation track 420 is arranged along the horizontal actuation track 325, and is arranged above the horizontal actuation track 325.

A vertical guide post 411 is arranged on the air extraction and gas charging tube 410, a bearing 411*a* is arranged on the vertical guide post 411, and the vertical guide post 411 is slidably arranged in the vertical guide slot on the vertical actuation track 420 via the bearing 411*a*.

In the process that the sealing module 300 is moved along the conveying path of the module conveying mechanism 100, the vertical guide post 411 slides along the vertical actuation track 420, the vertical actuation track 420 drives the air extraction and gas charging tube 410 to move up and down via the bearing 411*a* and the vertical guide post 411, and thereby the air extraction and gas charging tube 410 extends into the packaging bag 1 or retracts out of the packaging bag 1.

In a projection on the vertical plane, the distance between the vertical actuation track 420 and the packaging bag 1 is a vertical control distance, and the air extraction and gas charging tube can be controlled to extend into the packaging bag or retract out of the packaging bag by adjusting the vertical control distance.

According to the vertical control distance, the vertical actuation track 420 comprises a higher track section 422, a lower track section 421, and transition sections that connect the higher track section 422 and the lower track section 421; on the higher track section 422, the air extraction and gas charging tube 410 has retracted out of the packaging bag 1; on the lower track section 421, the air extraction and gas charging tube 410 has extended into the packaging bag 1;

the transition sections include an insertion transition section 423 from the higher track section 422 to the lower track section 421 and an extraction transition section 424 from the lower track section 421 to the higher track section 422;

on the insertion transition section 423, the air extraction and gas charging tube 410 extends from the outside of the packaging bag 1 into the inside of the packaging bag 1 gradually; on the extraction transition section 424, the air extraction and gas charging tube 410 retracts from the inside of the packaging bag 1 to the outside of the packaging bag 1 gradually.

Wherein, the insertion transition section 423 is arranged above the horizontal actuation track 325 correspondingly, and, as the vertical guide post 411 travels along the insertion transition section 423 towards the lower track section 421, the air extraction and gas charging tube 410 extends into the packaging bag 1 before the clamping opening 331 is closed; the extraction transition section 424 is arranged above the narrower track section 325*a* correspondingly, and the air extraction and gas charging tube 410 extracts from the packaging bag 1 before the clamping opening 331 is closed.

The narrower track section 325*a* is provided with an extra-narrow track section 325*c* on the corresponding track after the extraction transition section, and the sealing module 300 seals the packaging bag on the extra-narrow track section 325*c*; the horizontal control distance of the extra-narrow track section 325*c* is smaller than the horizontal control distance of the narrower track section, so that the left sealing block and the right sealing block get closer to each other further, the soft sealing strips 302 are compressed and deformed further, the heating blocks 301 on the left sealing block and the right sealing block abut against the two sides of the packaging bag, and the heating blocks heat up and seal the opening part of the packaging bag.

The bag conveying mechanism 200 is a chain transmission device, which comprises a first driving wheel (not shown), a first driven wheel (not shown), and a first chain 210; wherein, a tong 2 configured to clamp the packaging bag is arranged on the first chain 210.

The module conveying mechanism 100 is a chain transmission device, which comprises a second driving wheel, a second driven wheel, and a second chain 110; wherein, the base is arranged on the second chain.

The first driving wheel and the second driving wheel are arranged on the same main shaft and are in the same diameter, and the first chain and the second chain are at the same linear velocity. The second chain is shorter than the first chain. The air extraction and gas charging tube is connected to the vacuum generator and the nitrogen source respectively via a three-way control valve; or the air extraction and gas charging tube comprises an air extraction tube and a gas charging tube, wherein, the air extraction tube is connected to the vacuum generator, and the gas charging tube is connected to the nitrogen source through a pipeline via a control valve. Wherein, the reference number 3 represents a servo motor that drives the first driving wheel and the second driving wheel to rotate.

The module conveying mechanism is disposed at a sealing position on the bag conveying mechanism. During operation, the sealing module and the packaging bag are moved synchronously; in the initial stage, the sealing module is on the wider track section, the clamping opening is open, the opening part of the packaging bag is inserted into the clamping opening between the first sealing block and the second sealing block; as the sealing module is moved further together with the packaging bag synchronously, the sealing module passes by the track switching device, and the toothed rack structure on the push rod is meshed with the spur gear; as the sealing module is further moved along the spur gear, the spur gear rotates and pushes the push rod leftward or inward, so that the horizontal guide post transits from the wider track section to the narrower track section while the clamping opening is closed; before the clamping opening is closed, the vertical guide post fall onto the lower track section from the higher track section, and the air extraction and gas charging tube extends into the packaging bag.

As the sealing module is moved along the narrower track section together with the packaging bag, the air extraction and gas charging tube extracts air from the packaging bag and charges nitrogen into the packaging bag. Then, the air extraction and gas charging tube extracts from the packaging bag when the sealing module passes by the extraction transition section; next, the sealing module is moved along the extra-narrow track section, the clamping opening is further clamped, and the heating blocks operate to seal the packaging bag.

Next, as the sealing module passes by the track switching device, the clamping opening is opened and the packaging bag is released, and then the sealing module returns to the wider track section. In that way, the vacuum pumping, nitrogen charging, and sealing cycle is repeated.

The embodiments of the present invention are provided only for an illustrative and descriptive purpose, and they are not exhaustive or intended to limit the present invention to the disclosed forms. Various modifications and variations are obvious to those having ordinary skills in the art. The embodiments are selected and described only to interpret the principle and actual applications of the present invention better and enable those skilled in the art to understand the present invention and thereby design various variants suitable for specific applications.

We claim:

1. A sealing device, comprising:

a bag conveying mechanism configured to convey packaging bags;

a sealing module configured to seal the opening of a packaging bag; and a module conveying mechanism configured to convey the sealing module so that the sealing module is moved synchronously with the packaging bag;

wherein the sealing module is arranged above the packaging bag, wherein the sealing module comprises: a base and an actuator, and a first sealing block and a second sealing block arranged on the base, wherein the base is arranged on the module conveying mechanism, the first sealing block being hinged to the base, and a clamping opening being arranged between the first sealing block and the second sealing block, wherein the actuator is configured to open and close the clamping opening, wherein the actuator comprises a push rod and a horizontal actuation track, the push rod being horizontally slidably arranged on the base, a gear transmission structure being arranged between the push rod and the first sealing block, the push rod driving the first sealing block to swing via the gear transmission structure, and thereby the clamping opening is opened or closed, wherein a horizontal guide post is arranged vertically on the push rod and slidably connected to the horizontal actuation track, and the horizontal actuation track is arranged along a conveying path of the module conveying mechanism, wherein the sealing module is moved along the conveying path of the module conveying mechanism, the horizontal guide post sliding along the horizontal actuation track, the horizontal actuation track driving the push rod via the horizontal guide post to move horizontally, and thereby the clamping opening is opened or closed, wherein the push rod is perpendicular to the conveying path of the module conveying mechanism, wherein, in a projection on the horizontal plane, the distance between the horizontal actuation track and the module conveying mechanism is a horizontal control distance, wherein the size of the clamping opening is controlled by adjusting the horizontal control distance, wherein, according to the horizontal control distance, the horizontal actuation track comprises a wider track section and a narrower track section, wherein the clamping opening is opened when the sealing module travels on the wider track section, wherein the clamping opening is closed when the sealing module travels on the narrower track section, wherein, a transition track section is arranged between the wider track section and the narrower track section; or the wider track section and the narrower track section are separated from each other, and a track switching device is arranged between the wider track section and the narrower track section, the track switching device comprises a spur gear and a gear driving device, and the push rod is provided with a toothed rack structure meshed with the spur gear; in a process that the sealing module is conveyed, the gear driving device pushes the push rod to slide horizontally via the spur gear and the toothed rack structure, and, as the open/close state of the clamping opening is changed, the distance between the horizontal guide post and the module conveying mechanism is adjusted, and thereby transition between the wider track section and the narrower track section is realized, wherein the first sealing block and the second sealing block are respectively provided with a heating block configured to heating up and sealing an opening part of the packaging bag on one side of the clamping opening, and the heating blocks are connected to a power supply unit, wherein the first sealing block and the second sealing block are respectively provided with a soft sealing strip comprised of an elastic material on one side of the clamping opening, and wherein the first sealing block and the second sealing block clamp the packaging bag via the soft sealing strips, wherein the sealing device further comprises a vacuum pumping and nitrogen charging module configured to perform vacuum pumping and nitrogen charging for the packaging bag, wherein the vacuum pumping and nitrogen charging module comprises an air extraction and gas charging tube and a vertical actuation track, the air extraction and gas charging tube being arranged on the push rod in a way that it can slide up and down, and being connected to a vacuum generator and a nitrogen source respectively, wherein the air extraction and gas charging tube extend into the packaging bag for vacuum pumping and nitrogen charging for the packaging bag when it is moved downward, wherein the vertical actuation track is arranged along the horizontal actuation track, the air extraction and gas charging tube being provided with a vertical guide post slidably connected to the vertical actuation track, and wherein the sealing module is moved along the conveying path of the module conveying mechanism, the vertical guide post sliding along the vertical actuation track, the vertical actuation track driving the air extraction and gas charging tube to move up and down via the vertical guide post, and thereby the air extraction and gas charging tube extends into the packaging bag or retracts out of the packaging bag.

2. The sealing device according to claim 1, wherein a horizontal guide slot is arranged on the horizontal actuation track, and wherein the horizontal guide post is slidably arranged in the horizontal guide slot.

3. The sealing device according to claim 2, wherein a bearing is arranged on the horizontal guide post, and wherein the horizontal guide post is slidably arranged in the horizontal guide slot via the bearing.

4. The sealing device according to claim 1, wherein the second sealing block is rotatably arranged on the base, a gear mechanism being arranged between the first sealing block and the second sealing block, and the first sealing block and the second sealing block swinging synchronously via the gear mechanism, and wherein the clamping opening is closed when the first sealing block and the second sealing block are moved toward each other, and the clamping opening is opened when the first sealing block and the second sealing block are moved away from each other.

5. The sealing device according to claim 1, wherein in a projection on the vertical plane, the distance between the vertical actuation track and the packaging bag is a vertical control distance, and wherein the air extraction and gas charging tube can be controlled to extend into the packaging bag or retract out of the packaging bag by adjusting the vertical control distance.

6. The sealing device according to claim 5, wherein, according to the vertical control distance, the vertical actuation track comprises a higher track section, a lower track section, and transition sections that connect the higher track section and the lower track section, wherein, on the higher track section, the air extraction and gas charging tube has retracted out of the packaging bag, wherein, on the lower track section, the air extraction and gas charging tube has extended into the packaging bag, wherein the transition sections are comprised of an insertion transition section from the higher track section to the lower track section and an extraction transition section from the lower track section to the higher track section, wherein, on the insertion transition section, the air extraction and gas charging tube extend from the outside of the packaging bag into the inside of the packaging bag gradually, and wherein, on the extraction transition section, the air extraction and gas charging tube retract from the inside of the packaging bag to the outside of the packaging bag gradually.

7. The sealing device according to claim 6, wherein the insertion transition section is arranged above the horizontal actuation track correspondingly, and, as the vertical guide post travels along the insertion transition section towards the lower track section, the air extraction and gas charging tube extends into the packaging bag before the clamping opening is closed, and wherein the extraction transition section is arranged above the narrower track section correspondingly, the air extraction and gas charging tube extracting from the packaging bag before the clamping opening is closed.

8. The sealing device according to claim 7, wherein the narrower track section is comprised of an extra narrow track section on the corresponding track after the extraction transition section, wherein the sealing module seals the packaging bag on the extra-narrow track section, wherein the horizontal control distance of the extra-narrow track section is smaller than the horizontal control distance of the narrower track section, so that the left sealing block and the right sealing block get closer to each other further, wherein the soft sealing strips are compressed and deformed further, the heating blocks on the left sealing block and the right sealing block abutting against the two sides of the packaging bag, and wherein the heating blocks heat up and seal the opening part of the packaging bag.

9. The sealing device according to claim 1, wherein a vertical guide slot is arranged on the vertical actuation track, and wherein the vertical guide post is slidably arranged in the vertical guide slot.

10. The sealing device according to claim 9, wherein a bearing is arranged on the vertical guide post, and wherein the vertical guide post is slidably arranged in the vertical guide slot via the bearing.

11. The sealing device according to claim 1, wherein the bag conveying mechanism is a chain transmission device, being comprised of a first driving wheel, a first driven wheel, and a first chain, wherein a tong configured to clamp the packaging bag is arranged on the first chain, wherein the module conveying mechanism is a chain transmission device, being comprised of a second driving wheel, a second driven wheel, and a second chain, and wherein the base is arranged on the second chain.

12. The sealing device according to claim 11, wherein the first driving wheel and the second driving wheel are arranged on the same main shaft and are in the same diameter, and wherein the first chain and the second chain are at the same linear velocity.

* * * * *